US010478742B2

(12) United States Patent
Beaulieu et al.

(10) Patent No.: US 10,478,742 B2
(45) Date of Patent: Nov. 19, 2019

(54) TOY CONSTRUCTION ELEMENT

(71) Applicant: Mattel-MEGA Holdings (US), LLC, El Segundo, CA (US)

(72) Inventors: Louis-Philippe Beaulieu, Montréal (CA); Muryllo Cardoso Figueiredo De Matos, Lachine (CA)

(73) Assignee: Mattel-MEGA Holdings (US), LLC, El Segundo, CA (US)

( * ) Notice: Subject to any disclaimer, the term of this patent is extended or adjusted under 35 U.S.C. 154(b) by 0 days.

(21) Appl. No.: 15/916,922

(22) Filed: Mar. 9, 2018

(65) Prior Publication Data

US 2019/0275441 A1 Sep. 12, 2019

(51) Int. Cl.
*A63H 33/08* (2006.01)
*A63H 33/10* (2006.01)

(52) U.S. Cl.
CPC ..... *A63H 33/102* (2013.01); *A63H 33/101* (2013.01)

(58) Field of Classification Search
CPC ..... A63H 33/086; A63H 33/04; A63H 33/08; A63H 33/088; A63H 33/101; A63H 33/108; A63H 33/102
USPC ..... 446/124, 125, 126, 128; D21/479, 484, D21/485, 486, 491, 500, 504, 505
See application file for complete search history.

(56) References Cited

U.S. PATENT DOCUMENTS 2,175,942 A * 10/1939 Longenecker ..... A47F 5/00 211/1
2,791,868 A * 5/1957 Viken ..... A63H 33/062 428/11
3,242,610 A 3/1966 Christiansen
3,670,449 A * 6/1972 Lemkin ..... A63H 33/088 446/102
4,214,403 A 7/1980 Knudsen
D291,100 S 7/1987 Knudsen
(Continued)

FOREIGN PATENT DOCUMENTS

DE 2843679 A1 4/1979
GB 1012305 A1 12/1965
GB 2469543 A1 10/2010

OTHER PUBLICATIONS

"The Flexo System", Apr. 5, 2017, 2 pages. Retrieved from Internet: <https://web.archive.org/web/20170405225431/https://www.flexo.nz/about/>.

*Primary Examiner* — Vishu K Mendiratta
(74) *Attorney, Agent, or Firm* — Plumsea Law Group, LLC

(57) ABSTRACT

A toy construction element includes a first face recessed from a second face by a recess height, a first peg extending from the second face, and an engaging member disposed on the first face. The first peg has a first peg height relative to the second face. The engaging member may include a column portion and a peg portion, wherein the column portion extends from a first end portion at the first face to a second end portion at which the peg portion is disposed. The column portion may have a column height substantially equal to the recess height, and the peg portion may have a peg portion height substantially equal to the first peg height. A toy construction element may be part of a toy construction assembly, in which an engaging member of the toy construction element connects to a hole defined by a flexible member.

20 Claims, 11 Drawing Sheets

(56) References Cited

U.S. PATENT DOCUMENTS

| | | | | |
|---|---|---|---|---|
| 4,919,268 | A * | 4/1990 | Young | A63H 33/088 206/509 |
| D326,877 | S | 6/1992 | Andersen | |
| 6,068,533 | A | 5/2000 | Glickman et al. | |
| 6,231,416 | B1 | 5/2001 | Clever et al. | |
| 6,422,909 | B2 | 7/2002 | Clever et al. | |
| 6,592,421 | B1 | 7/2003 | Clever | |
| 7,040,949 | B2 | 5/2006 | Slocum | |
| D537,485 | S | 2/2007 | Ganderton | |
| 8,109,803 | B2 | 2/2012 | Kichijo et al. | |
| 8,197,297 | B2 | 6/2012 | Shimizu | |
| 8,435,095 | B1 | 5/2013 | Abbas | |
| D695,851 | S | 12/2013 | Holm | |
| D701,925 | S | 4/2014 | Jensen | |
| 8,808,051 | B2 | 8/2014 | Wei | |
| D754,260 | S * | 4/2016 | Chen | D21/484 |
| D771,199 | S | 11/2016 | Ryaa | |
| 2003/0203702 | A1 | 10/2003 | Germerodt et al. | |
| 2006/0025034 | A1 | 2/2006 | Slocum | |
| 2008/0136098 | A1 | 6/2008 | Yang | |
| 2012/0324708 | A1 | 12/2012 | Minin | |

* cited by examiner

TOY CONSTRUCTION ELEMENT

BACKGROUND

Field

The present embodiments relate generally to toy construction elements, and more particularly, to elements configured to be connected by a flexible member.

Background

Interlocking stackable toy construction blocks are well known in the field of toys and games. Although blocks may come in various sizes and shapes, a typical block is rectangular in shape and has upwardly projecting pegs on its top surface arranged in a matrix, and coupling means on its bottom surface for releasably interlocking the block to the top of another similar toy construction block having upwardly projecting pegs. Multiple blocks of varying shapes and sizes may be assembled into various toy constructions, such as houses, cars, airplanes, spaceships, and animals.

SUMMARY

Embodiments may provide a toy construction element that includes a first face and a second face, where the first face is recessed from the second face by a recess height. The toy construction element may further include a first peg extending from the second face. The first peg may have a first peg height relative to the second face. The toy construction element may also include an engaging member disposed on the first face, where the engaging member includes a column portion and a peg portion. The column portion may extend from a first end portion at the first face to a second end portion at which the peg portion is disposed. The column portion may have a column height substantially equal to the recess height and the peg portion may have a peg portion height substantially equal to the first peg height.

In another aspect, embodiments may provide a toy construction assembly including a toy construction element and a flexible member defining a hole. The toy construction element may include a face and an engaging member disposed on the face. The engaging member may include a column portion and a peg portion. The column portion may extend from a first end portion at the face to a second end portion at which the peg portion is disposed. The flexible member may be assembled with the toy construction element with the engaging member disposed in the hole.

In another aspect, a toy construction element may include a base portion having a face and an engaging member disposed on the face. The engaging member may include a column portion and a peg portion. The base portion may define a coupling recess on a side of the toy construction element that is opposite the face. The coupling recess may be configured to receive a corresponding peg of another toy construction element.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Embodiments provide a toy construction assembly with two construction elements and a flexible member that can connect the two elements. The flexible member may allow the construction elements to be articulated with respect to one another in a manner that would not be possible if they were connected by a rigid part. The construction elements may be block-like construction elements and may have engaging members adapted to fit holes defined by the flexible member.

For purposes of convenience, various directional adjectives are used in describing the embodiments. For example, the description may refer to the top, bottom, and side portions or surfaces of a component. It may be appreciated that these are only intended to be relative terms, and, for example, the top and bottom portions may not always be aligned with vertical up and down directions depending on the orientation of a component or toy construction.

FIGS. 1-9 illustrate an embodiment of a toy construction assembly. FIGS. 11-14 illustrate another embodiment of a toy construction assembly.

Figure 1:
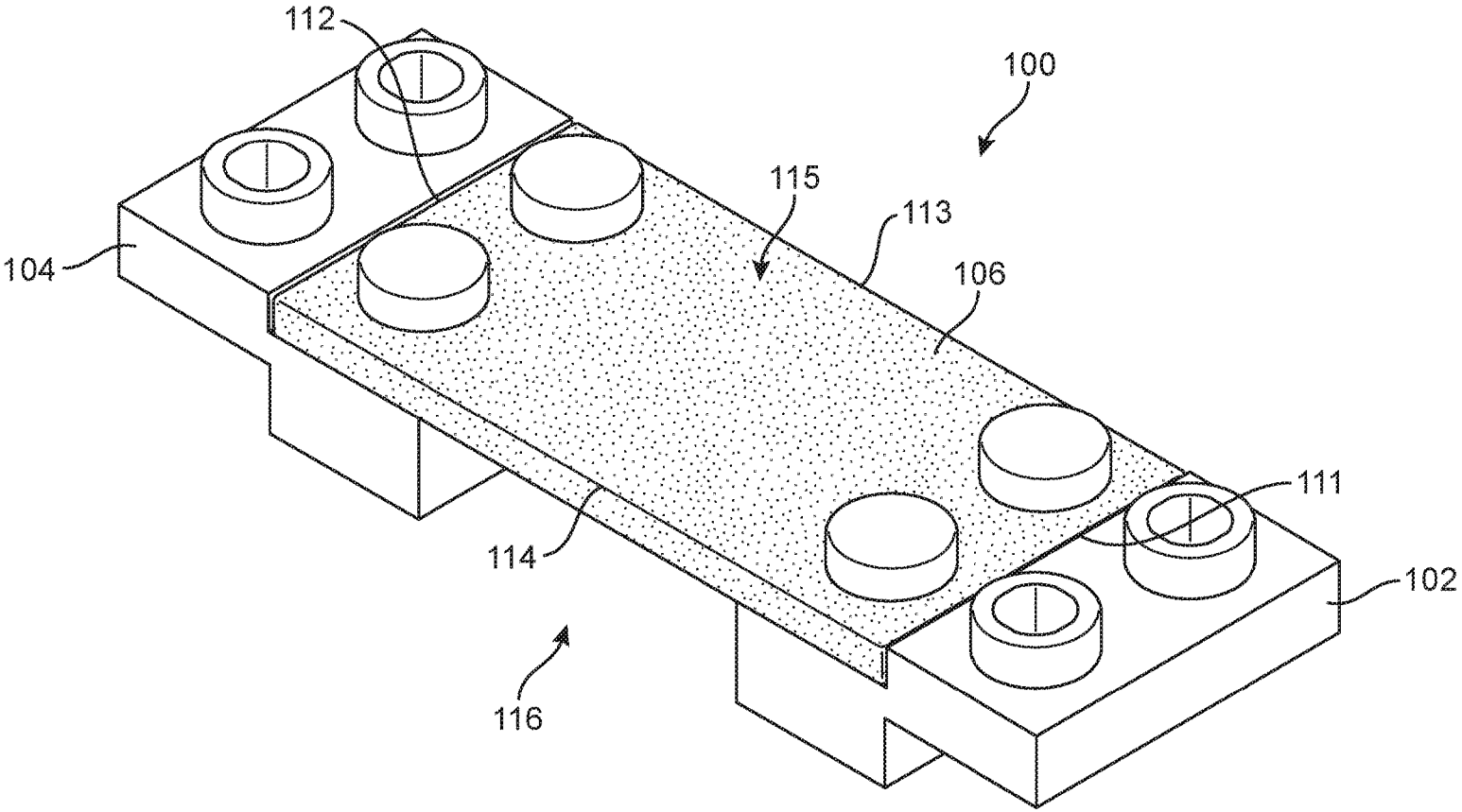
FIG. 1 is a schematic diagram that depicts a perspective view of an embodiment of a toy construction assembly.
Figure 2:
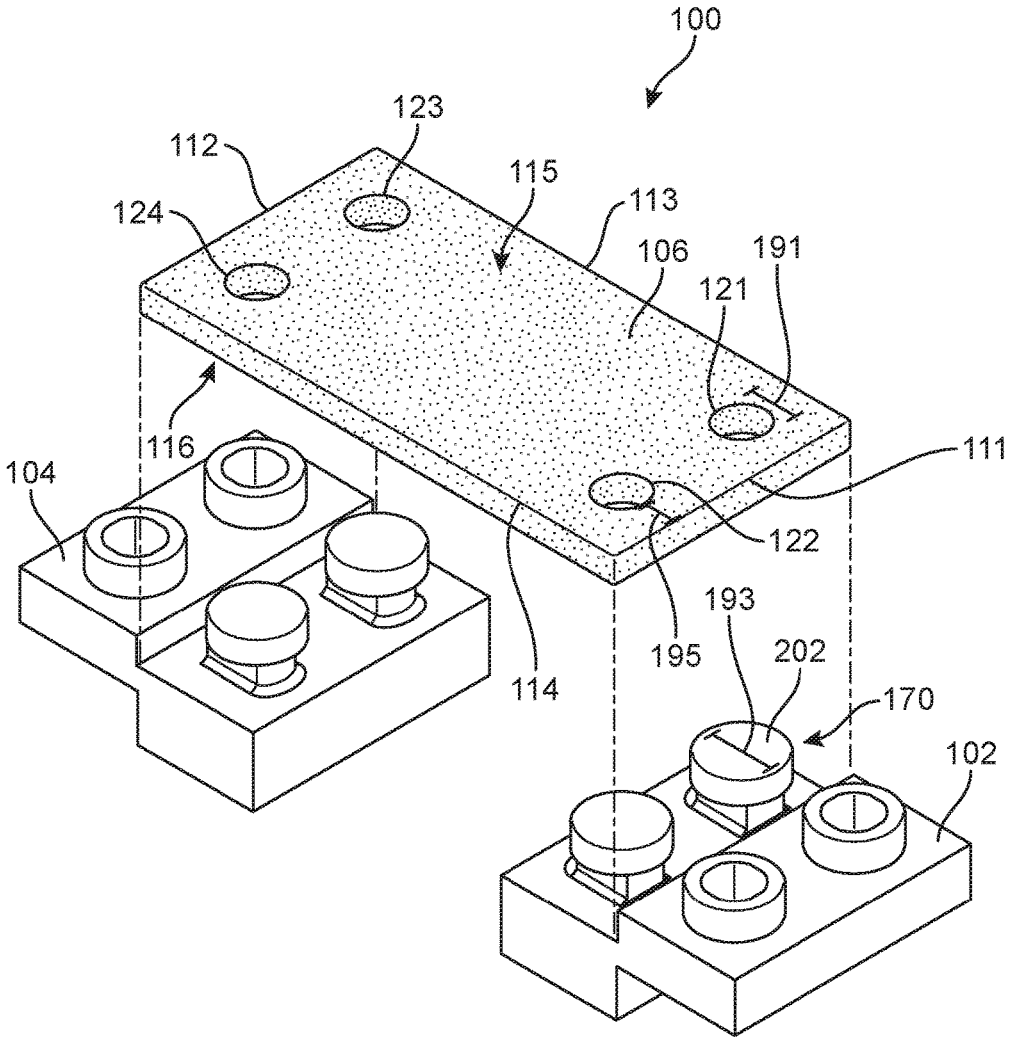
FIG. 2 is a schematic diagram that depicts a disassembled view of the toy construction assembly of FIG. 1.

FIG. 1 is a schematic diagram that depicts a perspective view of an embodiment of a toy construction assembly. FIG. 2 is a schematic diagram that depicts a disassembled view of the toy construction assembly of FIG. 2. Referring to FIGS. 1 and 2, a toy construction assembly 100 may comprise a first toy construction element 102, a second toy construction element 104, and a flexible member 106. Alternatively, a toy construction assembly could comprise only a flexible member and a single toy construction element. Moreover, it may be appreciated that a toy construction assembly could include additional elements, including block-like elements and/or additional flexible members configured to connect with the block-like elements.

Flexible Member

Flexible member 106 may include a first edge 111, a second edge 112, a third edge 113, and a fourth edge 114. Flexible member 106 may have a length defined by the distance between first edge 111 and second edge 112. Flexible member 106 may also have a width defined by the distance between third edge 113 and fourth edge 114. Flexible member 106 may also have a thickness defined as the distance between a first side 115 and a second side 116 of flexible member 106. In some embodiments, flexible member 106 may be elongated, such that a length of flexible member 106 may be greater than a width of flexible member 106. Moreover, in some embodiments, a thickness of flexible member 106 may be substantially less than both a length and a width of flexible member 106.

In some embodiments, flexible member 106 may have an approximately rectangular shape. In other embodiments, however, a flexible member may have any other shape. In some cases, depending on the shape, a flexible member may have fewer than, or more than, four edges. In embodiments, the shape and dimensions of a flexible member may conform to standard positions and sizes of a matrix of a toy construction system, discussed in more detail below.

In different embodiments, the structural properties of a flexible member could vary. Such structural properties that could vary include elasticity, flexibility, compressibility, and strength. Such properties may of course vary along different directions of a flexible member. In an exemplary embodiment, a flexible member may be sufficiently flexible so that the toy construction elements attached at either end can be articulated with respect to one another. Specifically, as the flexible member bends, the attached toy construction elements can be displaced out of a common plane. An example of flexible member 106 undergoing bending along a lengthwise direction can be seen in FIGS. 8-9. In different embodiments, a flexible material could be made of different materials. Exemplary materials that could be used include, but are not limited to, rubber, various kinds of flexible and elastic polymers, and silicone. Other exemplary materials could include various kinds of fabrics, textiles, and cloths, including woven and non-woven fabrics, textiles, and cloths.

Flexible member 106 may define one or more holes for engaging portions of a toy construction element (e.g., toy construction element 102). As seen in FIG. 2, flexible member 106 may include a first hole 121, a second hole 122, a third hole 123, and a fourth hole 124. Each hole may be configured to receive a corresponding engaging member on a toy construction element.

In an assembled configuration, flexible member 106 may extend between first toy construction element 102 and second toy construction element 104. More specifically, in some cases, a first end portion of flexible member 106 that includes first edge 111 may be attached to first toy construction element 102 and a second end portion of flexible member 106 that includes second edge 112 may be attached to second toy construction element 104.

Toy Construction Element

Figure 3:
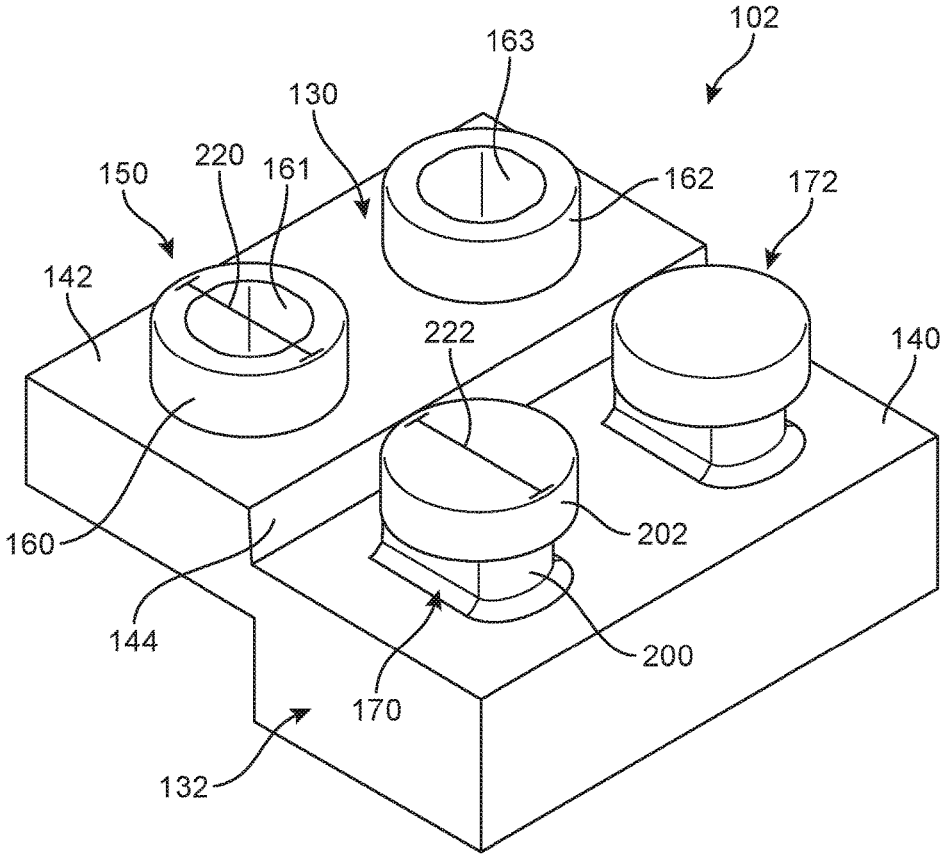
FIG. 3 is a schematic diagram of a perspective view that depicts an embodiment of a toy construction element.
Figure 4:
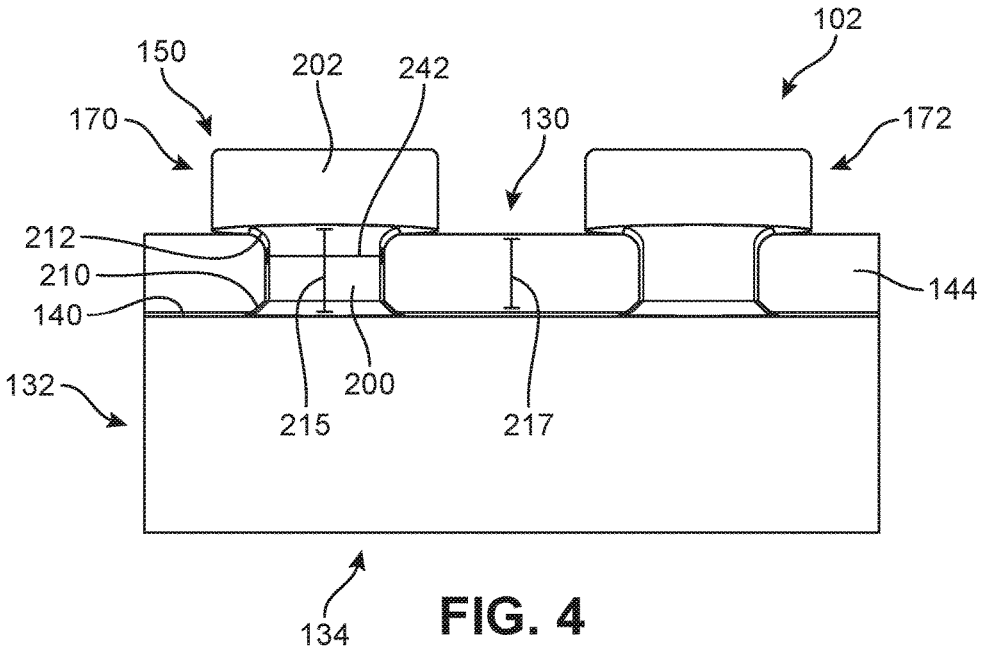
FIG. 4 is a schematic diagram that depicts a front view of the toy construction element of FIG. 3.
Figure 5:
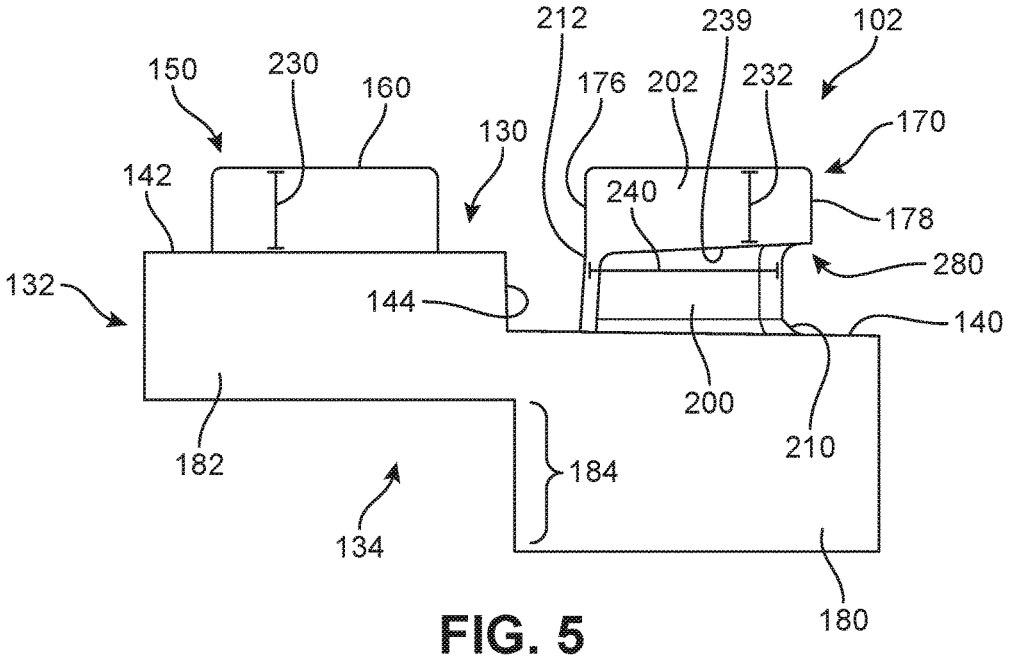
FIG. 5 is a schematic diagram that depicts a side view of the toy construction element of FIG. 3.
Figure 6:
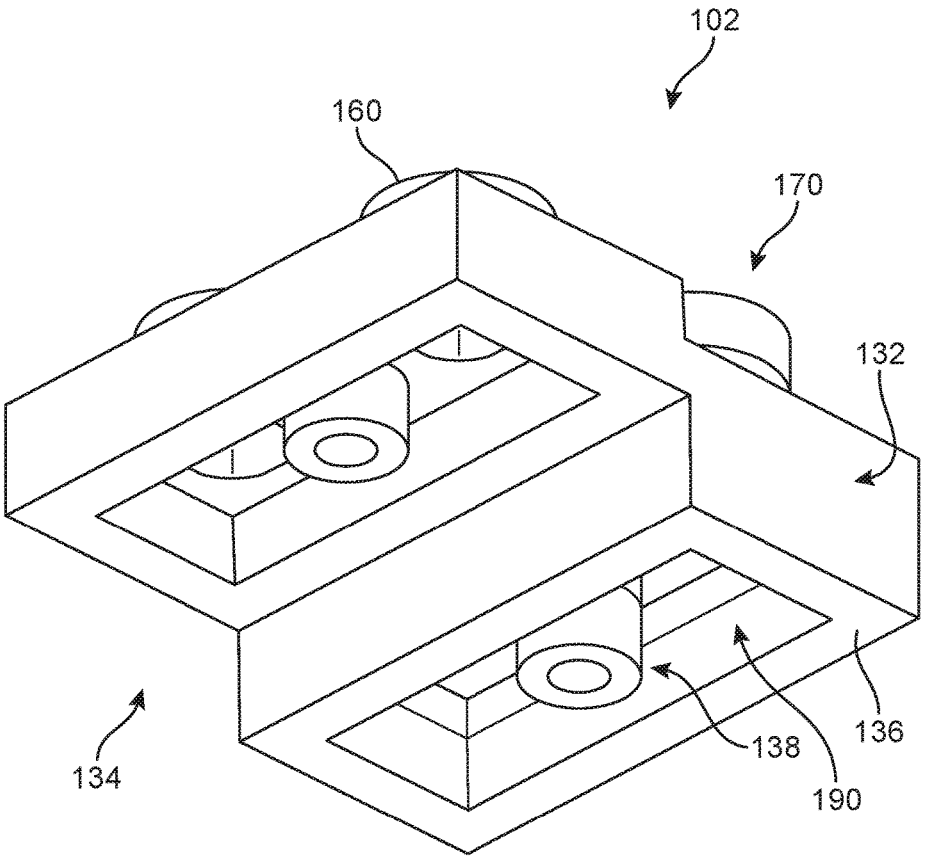
FIG. 6 is a schematic diagram that depicts a bottom perspective view of the toy construction element of FIG. 3.

Several views of toy construction element 102 are depicted schematically in FIGS. 3-7, according to embodiments. Referring first to FIG. 3, toy construction element 102 (also referred to simply as "construction element 102" hereafter) may be a block-like element with various features for attaching to one or more other construction elements (e.g., blocks and flexible members) or related parts. Construction element 102 may be comprised of a top portion 130 and a plurality of sidewall portions 132 (e.g., four sidewalls in the embodiment of FIGS. 3-7). Additionally, toy construction element 102 may include a lower portion 134, as seen in FIG. 6.

Each side or portion of a toy construction element may include one or more faces. Each face may be approximately flat, apart from pegs, openings, or other structural features. For example, top portion 130 may comprise a first face 140 and a second face 142. First face 140 may be recessed with respect to second face 142. Moreover, a third face 144 may extend in a substantially perpendicular manner between first face 140 and second face 142 so that together these faces form a step-like geometry on top portion 130.

In some embodiments, construction element 102 may include features for interfacing with other blocks or objects. As seen in FIG. 3, construction element 102 may include a plurality of cylindrical pegs, or peg-like projections, that protrude from top portion 130. Pegs may be alternatively referred to as studs, prongs, or cylindrical projections. In addition to regular pegs, embodiments may incorporate structures that include peg portions at one end. For clarity, pegs and structures with peg portions or peg-like features may also be collectively referred to as "projecting portions." Construction element 102 may be seen to include a plurality of projecting portions 150.

Construction element 102 may further define one or more coupling recesses defined by hollow cylindrical portions and walls that extend down from lower portion 134. As seen in FIG. 6, cylindrical portions 138 extend from lower portion 134 and may have lower surfaces that are approximately flush with the lower surface 136 of sidewall portions 132.

The cylindrical pegs atop construction element 102 and the hollow cylindrical portions disposed on a lower side of construction element 102 may facilitate the joining of other elements (including blocks) with construction element 102. Exemplary construction blocks that may couple with the projecting portions 150 are MEGA BLOKS MICROBLOKS produced by MEGA BRANDS INC. of Montreal, Canada. In general, toy construction blocks are well known in the art and come in various sizes and shapes. The blocks are often rectangular in shape and have upwardly projecting pegs on their top surface arranged in an array or matrix, and means on their bottom surface for releasably interlocking one of these blocks on top of another toy construction block. Many other shapes are possible. Using a plurality of these blocks, one may assemble various structures, such as houses, cars, and airplanes. These blocks are extremely versatile given the variety of shapes available and their easy interlocking mechanism. Examples of toy construction blocks are disclosed in U.S. Pat. No. 5,827,106, issued Oct. 27, 1998, and U.S. Pat. No. 5,779,515, issued Jul. 14, 1998, both of which are herein incorporated by reference in their entirety.

A construction element may comprise projecting portions that are arranged in a particular array or matrix. Each array may be characterized by a number of rows of projecting portions and the number of projecting portions within each row (e.g., rows and columns of projecting portions). As an example, construction element 102 is configured as a 2×2 array, with projecting portions approximately equally spaced in 2 rows of 2 projecting portions each. Alternatively, a block or other construction element could be configured in any other kind of array, including 1×2, 1×3, 1×4, 2×2, 2×3, 2×4, 3×3, 3×4, as well as any other arrays of projecting portions. As used herein, a one-dimensional array refers to a configuration of projecting portions into a single row (or column). That is, in a one-dimensional array every projecting portion may lie along a common axis. By contrast, a two-dimensional array is an array with at least two rows and two columns of projecting portions such that the projecting portions may all lie in a common plane.

As seen in FIG. 3, construction element 102 includes first peg 160 and second peg 162. First peg 160 and second peg 162 may extend from second face 142. In some cases, pegs may include central holes. For example, first peg 160 may include first peg hole 161 and second peg 162 may include second peg hole 163. In some cases, these peg holes may be configured to receive posts or other construction parts. In other embodiments, peg hole 161 and/or peg hole 163 could be omitted.

Construction element 102 may also include first engaging member 170 and second engaging member 172 that extend from first face 140. In contrast to first peg 160 and second peg 162, each engaging member may comprise a column portion and a peg portion, wherein the column portion and the peg portion may differ in size and/or geometry.

When viewed from above (for example, as in FIG. 7), first peg 160, second peg 162, first engaging member 170, and second engaging member 172 may be seen as arranged in a square configuration (i.e., a 2×2 array). Of course, other embodiments could be sized to accommodate additional pegs and/or engaging members that may be arranged in any sized array with respect to a horizontal direction. For example, some embodiments could include a single peg and a single engaging member arranged as a 1×2 array. In such an array, a first peg may be disposed at a first row and a first column of a matrix and a peg portion of a first engaging member may be disposed at the first row and a second column of the matrix.

In some embodiments, a construction element may be provided with a plurality of openings for receiving complementary-shaped construction toy pieces. For example, on lower portion 134 of construction element 102 hollow cylindrical portions 138 and sidewall portions 132 may be positioned to form distinct opening regions, or coupling recesses, for receiving corresponding pegs on another block. As an example, a first opening region 190 may be associated with the interior surfaces of sidewall portions 132 and the sidewalls of an adjacent cylindrical portion. First opening region 190 may receive a peg from another construction element so that an interference fit can be formed between the received peg (or other projecting portion) and construction element 102. The configuration of construction element 102, with two separate hollow cylindrical portions extending through lower portion 134, provides four distinct opening regions, each corresponding with a projecting portion (e.g., a peg or a peg-portion of an engaging member) on the opposite side of construction element 102. Thus, as with the projecting portions on top of construction element 102, the opening regions (or simply openings) on the lower portion of construction element 102 are also configured in arrays (i.e., a 2×2 array of openings for construction element 102). Examples of construction elements (e.g., blocks) with openings receiving construction toy pieces are disclosed in U.S. Pat. No. 7,666,054, issued Feb. 23, 2010, which is herein incorporated by reference in its entirety.

When construction elements having projecting portions are stacked so that projecting portions of one element fit into recesses of another element, the resulting assembled component may be characterized as having a three-dimensional array or matrix of projecting portions. For example, two one-unit-high blocks that each have a 2×2 array of pegs, when stacked, may be seen to comprise a 2×2×2 array (or matrix), where the third number indicates the number of vertically stacked projecting portions (i.e., a vertical column of projecting portions). Similarly, construction elements with any 2D array of projecting portions could be stacked with one, two, or more other construction elements with similar 2D arrays to form stacked elements with a 3D array of projecting portions. Of course, the characterization of projecting portions as arranged in 2D or 3D arrays may also apply to only part of an assembled construction, since in some cases parts with different sized 2D arrays could still be stacked together. For example, a 2×2 block could be stacked over a 2×3 block and the resulting construction would still contain a 2×2×2 sub-array of projecting portions.

As best seen in FIG. 5, construction element 102 includes a first base portion 180 corresponding to first face 140 and a second base portion 182 corresponding to second face 142. In some cases, first base portion 180 may be configured to receive a projecting portion directly beneath first engaging member 170. In some cases, opening 190 (see FIG. 6) within first base portion 180 has sufficient depth to receive an entire engaging member with a height approximately equivalent to the height of first engaging member 170. In some cases, the height of first base portion 180 may be substantially greater than the height of second base portion 182. In the present embodiment, second base portion 182 may only be configured to receive a peg rather than a (taller) engaging member. This creates a vertical offset 184 in the bottom portions of first base portion 180 and second base portion 182 that may be large enough for a whole engaging member to fit within opening 190 of base portion 180. In some embodiments, this offset in the two adjacent base portions may help with improved construction play by allowing the user to lock construction element 102 into a smaller area (e.g., into a 1×2 block area instead of a 2×2 area that would be required if the base portions were at the same level). In another embodiment, depicted in FIGS. 11-12, a base portion 310 of construction element 312 may have a depth to receive only a corresponding peg portion rather than an entire engaging member.

Engaging Members

As discussed above, each engaging member may comprise a column portion and a peg portion. For example, as seen in FIGS. 3-5, first engaging member 170 includes a column portion 200 and a peg portion 202. As seen in FIGS. 4-5, column portion 200 may include a first end portion 210 attached at face 140, and column portion 200 may extend from first end portion 210 to a second end portion 212 at which peg portion 202 is attached.

The following description characterizes a first engaging member 170; however, it may be appreciated that any of the provisions described here may also be applicable to second engaging member 172 as well as any additional engaging members included in other embodiments.

Peg Portions

Peg portion 202 may be similar in some respects to first peg 160. In some cases, both peg portion 202 and first peg 160 may have similar dimensions and shapes. In one embodiment, both peg portion 202 and first peg 160 have an approximately cylindrical geometry. In addition, both peg portion 202 and first peg portion 160 may have similar dimensions that may be characterized by a diameter. That is, first peg 160 may have a diameter 220 and peg portion 202 may have a diameter 222 (see FIG. 3). In some cases, diameter 220 and diameter 222 may be substantially equal.

Peg portion 202 and first peg 160 may also have a similar height. Specifically, first peg 160 may have a first peg height 230 that extends from second face 142 to a top end of first peg 160. Peg portion 202 may have a peg portion height 232 that extends from second end portion 212 of column portion 200 to a top end of peg portion 202. In some cases, first peg height 230 and peg portion height 232 may be equal. In some cases, this configuration may be useful for ensuring a uniform connection between projecting portions 150 (e.g., both pegs and peg portions) and corresponding recesses in a construction element that may be stacked on top of construction element 102.

Column Portions

Column portion 200 may provide support to peg portion 202 while also providing an attachment point for a flexible member (e.g., flexible member 106). In some cases, the geometry of column portion 200 may be selected to achieve good structural support while also facilitating a good fit with a flexible member.

Column portion 200 may have a height that is substantially equal to the recessed distance between first face 140 and second face 142. In particular, as best seen in FIG. 4, column portion 200 may have a column height 215 that is substantially equal to a height 217 of third face 144. This configuration may ensure peg portion 202 is aligned with first peg 160 in a vertical direction (i.e., a direction substantially perpendicular to first face 140 and second face 142).

In order to help retain a portion of a flexible member, column portion 200 can have a geometry that is distinct from the geometry of peg portion 202. In some cases, the cross-sectional area of column portion 200 (taken in a plane substantially parallel with face 140) may be less than the cross-sectional area of peg portion 202 (also taken in a plane substantially parallel with face 140).

Furthermore, while peg portion 202 may have a substantially circular cross-sectional geometry, in some cases column portion 200 may have an elongated geometry characterized by a lengthwise dimension 240 (see FIG. 5) and a widthwise dimension 242 (see FIG. 4). In some cases, both lengthwise dimension 240 and widthwise dimension 242 may be less than diameter 222 of peg portion 202. In other cases, however, one or both of lengthwise dimension 240 and widthwise dimension 242 may be substantially equal to diameter 222.

In other embodiments, a column portion could have a rounded (e.g., circular) geometry. For example, in another embodiment of a toy construction assembly depicted in FIGS. 11-14, a construction element 312 may include a column portion 314 with a cylindrical geometry. Column portion 314 may have a smaller diameter than a corresponding peg portion 316. Other shapes, sizes, and geometries of the peg portion and column portion are also possible, while still helping to retain a flexible member.

Referring back to FIGS. 3-5, the distinctive cross-sectional geometries of column portion 200 and peg portion 202 that may be present in some embodiments may help engagement member 170 retain a portion of flexible member 106.

As seen in FIG. 5, engaging member 170 may have a first side 176 facing towards third face 144 and a second side 178 facing away from third face 144. When viewed from the side view of FIG. 5, first side 176 may be considered approximately straight with respect to the vertical direction. Specifically, at peg portion 202, first side 176 may comprise an approximately vertical wall (i.e., a wall oriented in a direction substantially perpendicular to face 140). At column portion 200, first side 176 may be slightly angled along first side 176. Specifically, the first end portion 210 of column portion 200 on first side 176 may be spaced from third face 144 by a shorter distance than second end portion 212 is spaced apart from third face 144.

Additionally, in some cases, first side 176 may have a convex curvature that is curved with respect to a widthwise direction of column portion 200. As seen in the top plan view of construction element 102 shown in FIG. 7, at first side 176, column portion 200 may have a convex surface 287. Convex surface 287 may extend closest to third face 144 at a centerline 289 of column portion 200. Moreover, convex surface 287 may recede from third face 144 in a smooth manner between centerline 289 and opposing widthwise edges (i.e., first widthwise edge 283 and second widthwise edge 285) of column portion 200. This convex geometry may help in squeezing a portion of a flexible member between column portion 200 and third face 144. Other shapes, sizes, and geometries of the column portion are possible to compress a flexible member between a column portion and an opposing face.

Referring again to FIG. 5, on second side 178 of engaging member 170, an overhanging portion 280 of peg portion 202 is seen to extend past column portion 200 in a direction oriented away from third face 144. Of course, the overall geometry of column portion 200 may be such that peg portion 200 overhands on three of the column's four sides. In some cases, the overall geometry of column portion 200 may be selected to maximize the area under peg portion 202 where a flexible member can be retained, while also ensuring the column is solid and sufficiently strong.

Some embodiments can include additional provisions that facilitate with molding a part, such as a construction element. For example, in some cases where construction element 102 may be manufactured in a molding process (e.g., injection molding), the tapering lower edge 239 of peg portion 202 may help a moving part of the mold to retract more easily. Likewise, in some embodiments the angled first side 176 of column portion 200 may also help a moving part of a mold to retract more easily. Other angled geometries are possible to assist in retraction of mold parts.

Assembling Parts

Figure 8:
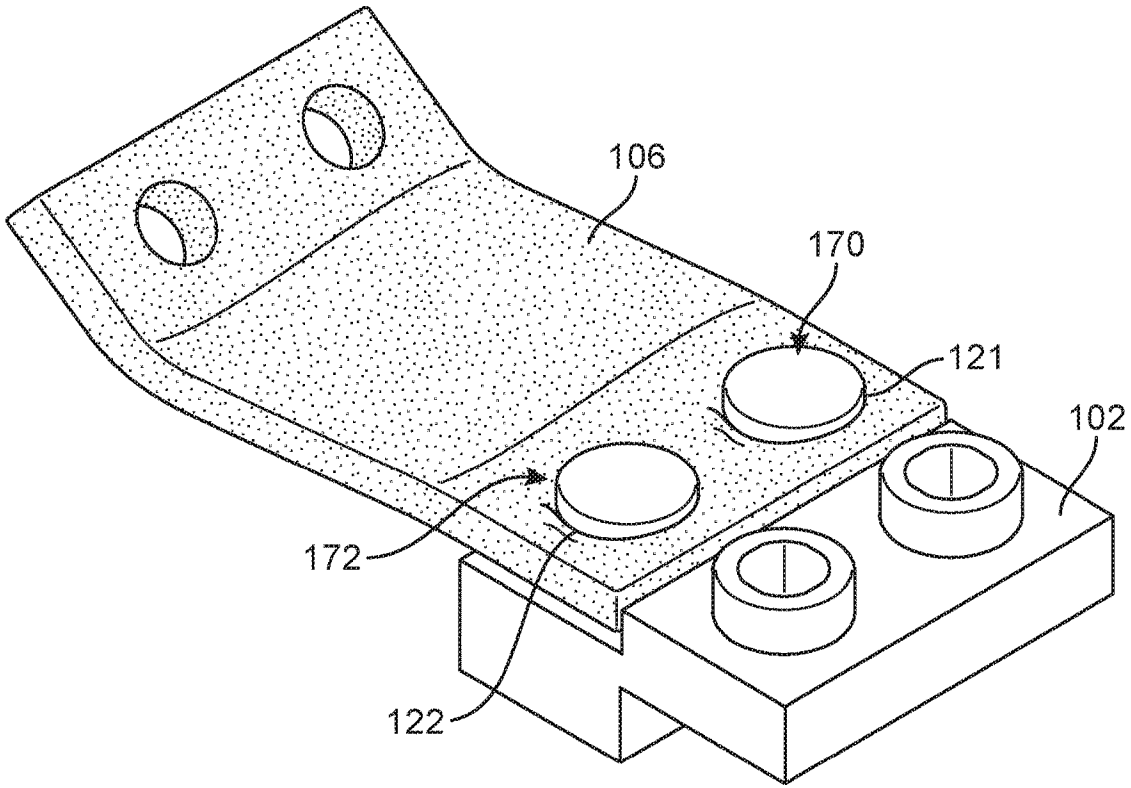
FIG. 8 is a schematic diagram that depicts a step in assembling a flexible member and a first toy construction element, according to an embodiment.
Figure 9:
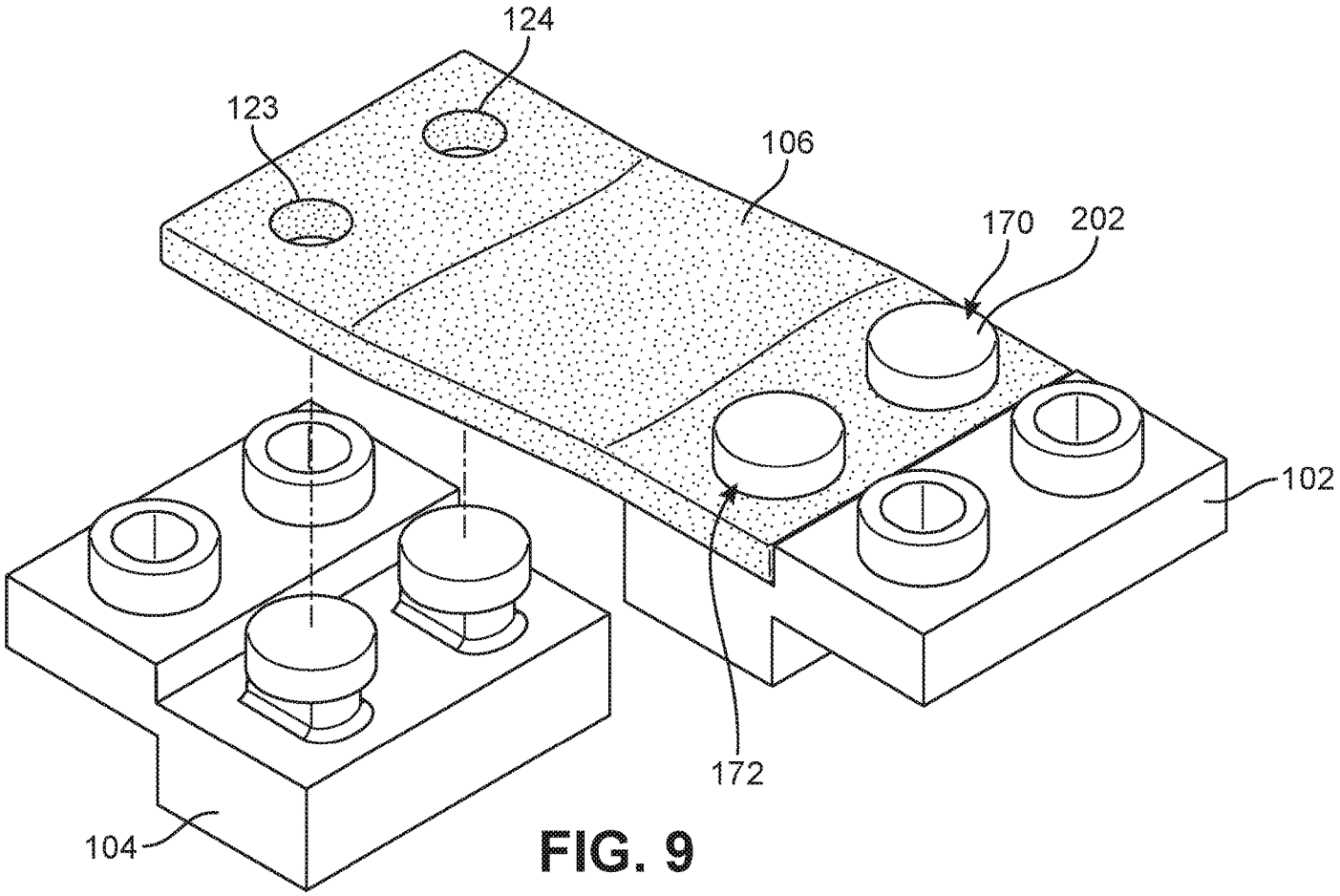
FIG. 9 is a schematic diagram that depicts a step in assembling a flexible member and a second toy construction element, according to an embodiment.

FIGS. 8-9 illustrate schematic views of flexible member 106 being assembled with construction element 102. As seen in FIG. 8, assembling flexible member 106 to construction element 102 may involve inserting first engaging member 170 and second engaging member 172 through first hole 121 and second hole 122 of flexible member 106 (see FIG. 2), respectively.

In some cases, the holes of flexible member 106 may have a smaller cross-sectional area than the peg portions of the engaging members. For example, as seen in FIG. 2, first hole 121 may have a diameter 191 that is greater than a corresponding diameter 193 of peg portion 202 of first engaging member 170. In order to insert an engaging member through a hole, the hole may be stretched in some cases, as shown in FIG. 8.

In FIG. 9, both first engaging member 170 and second engaging member 172 have been inserted through first hole 121 and second hole 122, respectively. In moving from the configuration shown in FIG. 8 to that shown in FIG. 9, first hole 121 and second hole 122 may contract in size as the column portions of each engaging member may have a smaller cross-sectional size (along at least one dimension) than the peg portions.

After assembling flexible member 106 with first toy construction element 102, flexible member 106 may also be assembled with second toy construction element 104 in a similar manner.

Figure 10:
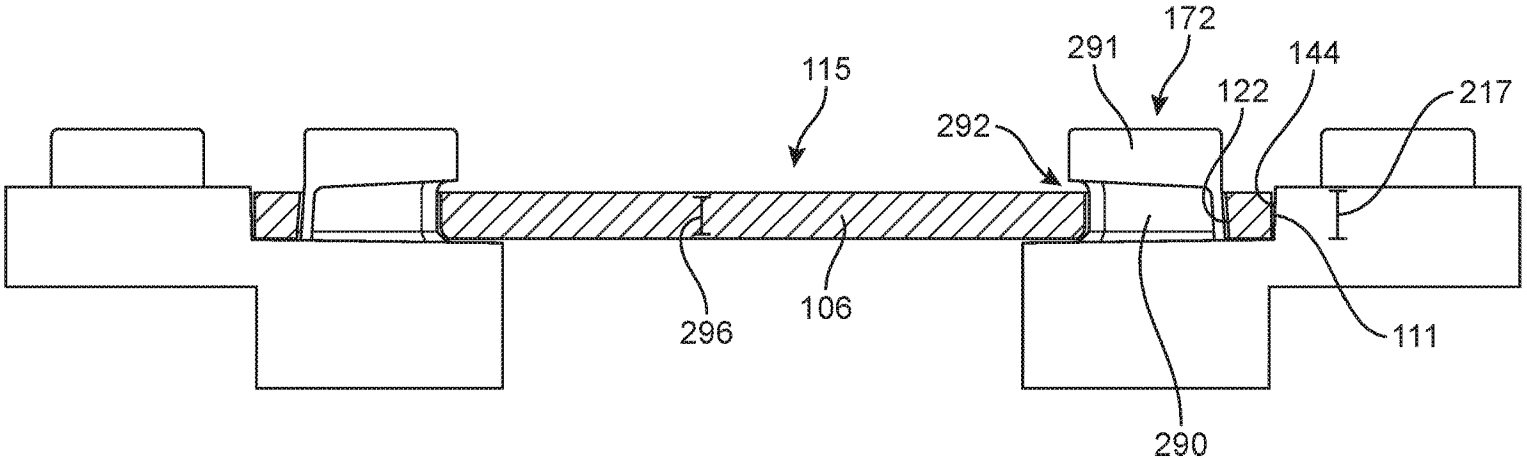
FIG. 10 is a schematic diagram that depicts a view of a toy construction assembly with a flexible member shown in cross-section, according to an embodiment.
Figure 11:
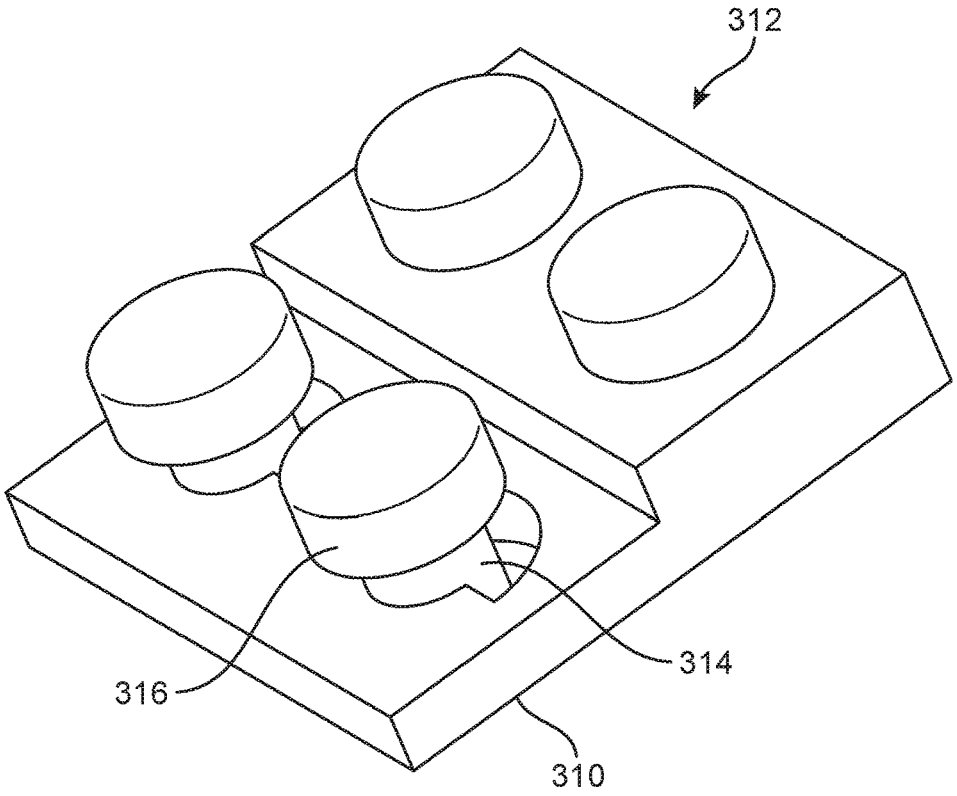
FIG. 11 is a schematic diagram that depicts a perspective view of another embodiment of a toy construction element.
Figure 12:
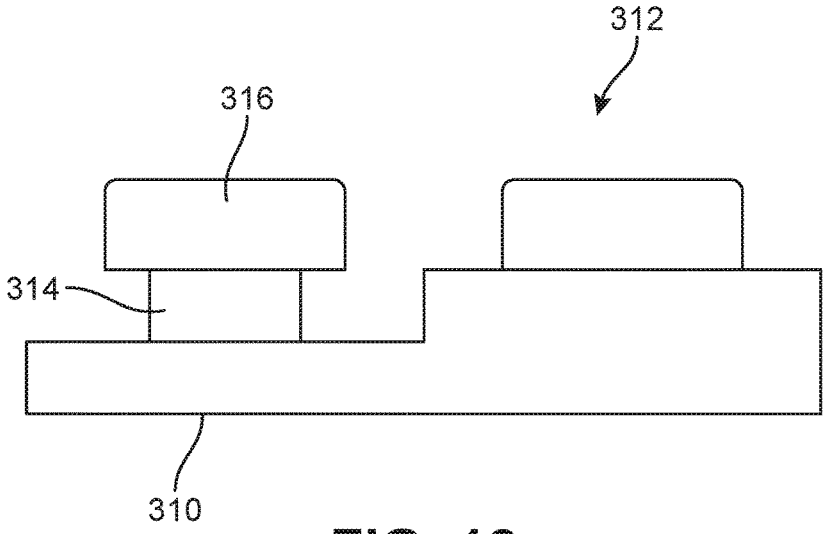
FIG. 12 is a schematic diagram that depicts a side view of the toy construction element of FIG. 11.
Figure 13:
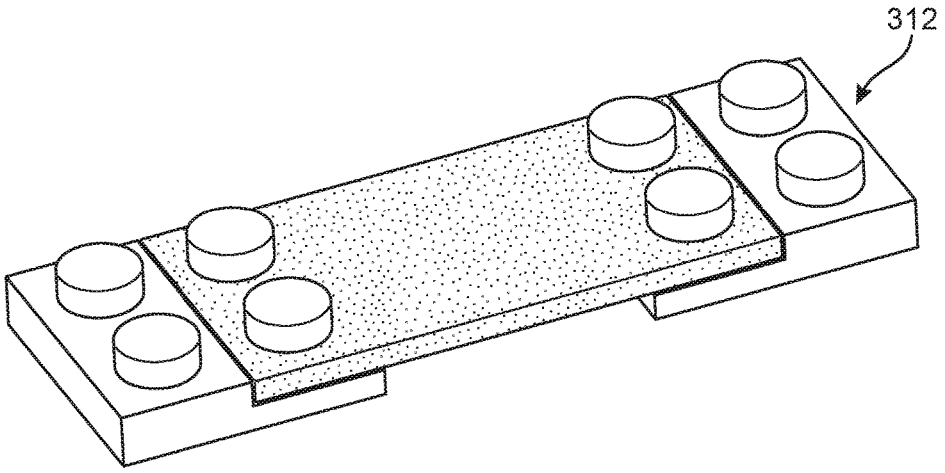
FIG. 13 is a schematic diagram that depicts an isometric perspective view of another embodiment of a toy construction assembly.
Figure 14:
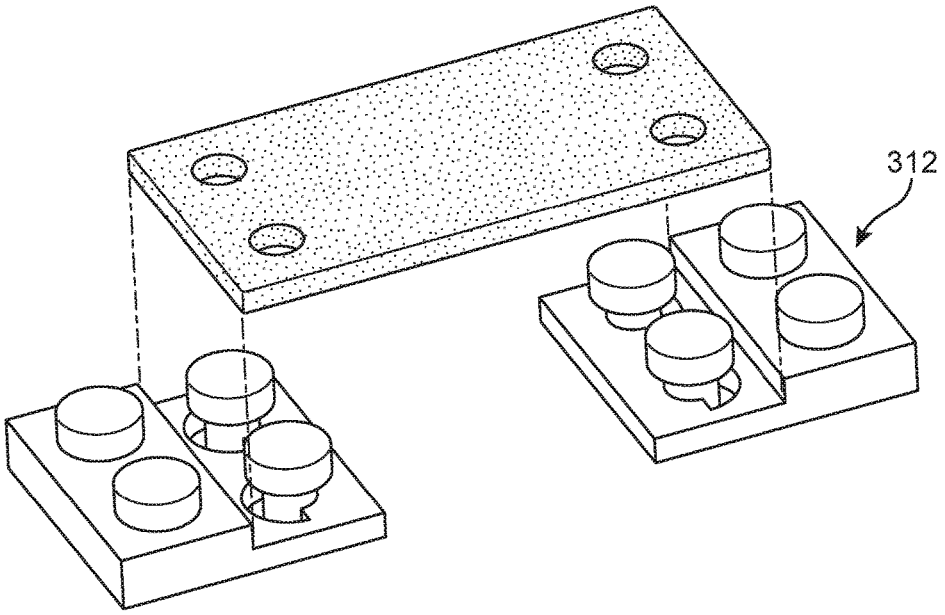
FIG. 14 is a schematic diagram that depicts a disassembled view of the toy construction assembly of FIG. 13.

FIG. 10 shows a schematic view of assembly 100 in which flexible member 106 is shown in cross-section. As seen in FIG. 10, a column portion 290 of second engaging member 172 is disposed within second hole 122. In addition, overhang portion 292 of peg portion 291 of second engaging member 172 extends over part of top side 115 of flexible member 106 to help retain flexible member 106 in place.

Figure 7:
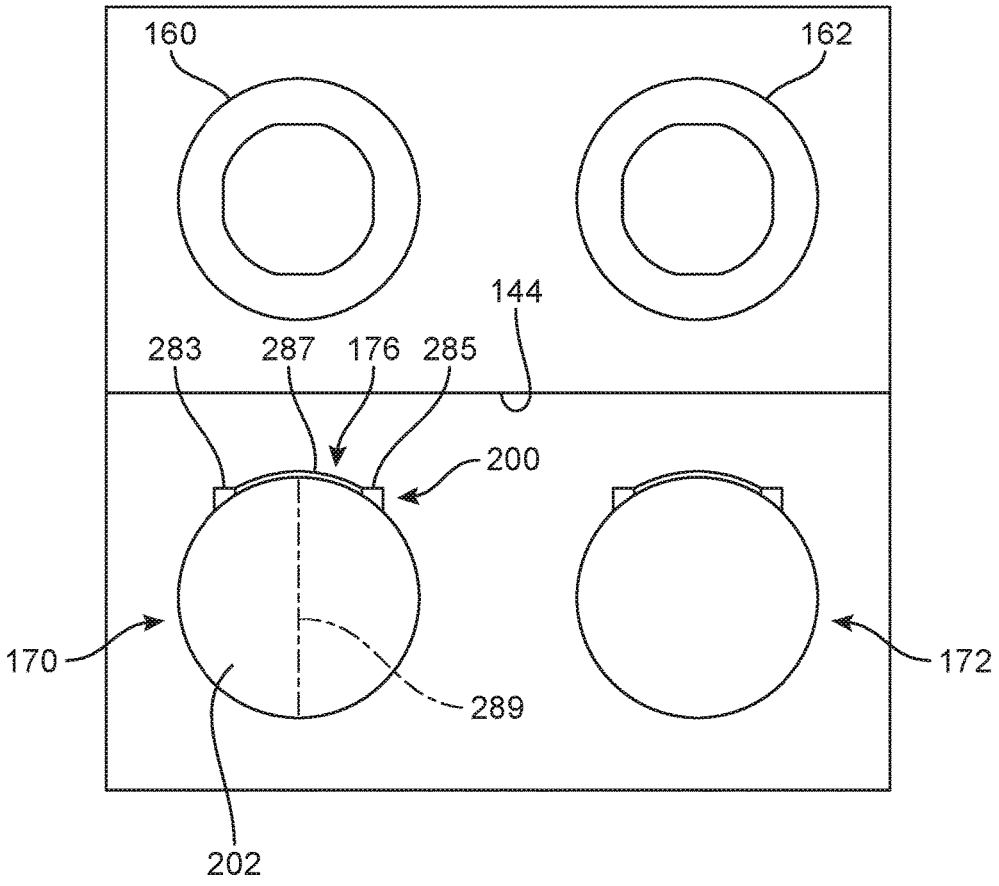
FIG. 7 is a schematic diagram that depicts a top plan view of the toy construction element of FIG. 3.

In some cases, as shown in FIGS. 7 and 10, the slight angle and/or curved geometry of column portion 290 may compress the end portion of flexible member 106 adjacent first edge 111 to help create a frictional fit between engaging member 172 and third face 144. In some cases, a width 195 between second hole 122 and first edge 111 (see FIG. 2) is greater than a distance between third face 144 and column portion 290.

As seen in FIG. 10, flexible member 106 may have a thickness 296 substantially equal to recess height 217 of third face 144. This may allow flexible member 106 to be flush with second surface 142 in the assembled configuration.

The foregoing disclosure of the embodiments has been presented for purposes of illustration and description. It is not intended to be exhaustive or to limit the embodiments to the precise forms disclosed. Many variations and modifications of the embodiments described herein will be apparent to one of ordinary skill in the art in light of the above disclosure.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present embodiments.

What is claimed is:

1. A toy construction element, comprising:

a first face and a second face, the first face being recessed from the second face by a recess height;

a first peg extending from the second face, the first peg having a first peg height relative to the second face; and an engaging member disposed on the first face, the engaging member including a column portion and a peg portion, wherein the column portion extends from a first end portion at the first face to a second end portion at which the peg portion is disposed, wherein the column portion has a column height substantially equal to the recess height, wherein the peg portion has a peg portion height substantially equal to the first peg height, wherein the first peg is disposed at a first row and a first column of an array, and wherein the peg portion of the engaging member is disposed at the first row and a second column of the array.

2. The toy construction element according to claim 1, wherein the peg portion has a different geometry than the column portion.

3. The toy construction element according to claim 2, wherein the peg portion has a circular cross-sectional geometry with a peg diameter.

4. The toy construction element according to claim 3, wherein the column portion has an elongated cross-sectional geometry including a column length and a column width, the column length being greater than the column width.

5. The toy construction element according to claim 4, wherein the column length is less than the peg diameter.

6. The toy construction element according to claim 1, wherein a distal portion of the first peg and a distal portion of the peg portion are substantially uniform in size and shape, and wherein a distal planar surface of the first peg and a distal planar surface of the peg portion lie in a common plane, such that the first peg and the peg portion are configured to be received in complementary uniform coupling recesses defined in a flat surface of a second toy construction element, when the flat surface of the second toy construction element rests on the second face and extends over the first face.

7. The toy construction element according to claim 1, wherein the array comprises a plurality of pegs arranged on the second face and a plurality of peg portions of engaging members arranged on the first face, the array comprising at least two rows and at least two columns.

8. The A toy construction element according to claim 1, comprising:

a first face and a second face, the first face being recessed from the second face by a recess height;

a first peg extending from the second face, the first peg having a first peg height relative to the second face; and an engaging member disposed on the first face, the engaging member including a column portion and a peg portion, wherein the column portion extends from a first end portion at the first face to a second end portion at which the peg portion is disposed, wherein the column portion has a column height substantially equal to the recess height, wherein the peg portion has a peg portion height substantially equal to the first peg height, wherein a substantially perpendicular face extends between the first face and the second face, wherein, when viewed from a side view, a side of the engaging member oriented towards the perpendicular face has a substantially straight geometry, and wherein, when viewed from the side view, a side of the engaging member oriented away from the perpendicular face has a substantially curved geometry.

9. The toy construction element according to claim 8, wherein an overhang portion of the peg portion extends past the column portion in a first direction, the first direction being a direction oriented away from the perpendicular face.

10. The A toy construction element, comprising:

a first face and a second face, the first face being recessed from the second face by a recess height;

a first peg extending from the second face, the first peg having a first peg height relative to the second face; and an engaging member disposed on the first face, the engaging member including a column portion and a peg portion, wherein the column portion extends from a first end portion at the first face to a second end portion at which the peg portion is disposed, wherein the column portion has a column height substantially equal to the recess height, wherein the peg portion has a peg portion height substantially equal to the first peg height, wherein a substantially perpendicular face extends between the first face and the second face, and wherein, when viewed from a side view, a side of the column portion facing the perpendicular face is angled such that the first end portion of the side of the column portion is closer to the perpendicular surface than the second end portion of the side of the column portion is to the perpendicular surface.

11. A toy construction assembly, comprising:

a flexible member defining a hole; and a toy construction element comprising:

a face; and an engaging member disposed on the face, the engaging member including a column portion and a peg portion, wherein the column portion extends from a first end portion at the face to a second end portion at which the peg portion is disposed, wherein the flexible member is assembled with the toy construction element with the engaging member disposed in the hole, wherein the toy construction element has a second face, wherein the face is recessed from the second face by a recess height, wherein a substantially perpendicular face extends between the face and the second face, wherein the column portion has a column height substantially equal to the recess height, wherein the toy construction element includes a first peg extending from the second face, wherein the first peg has a first peg height relative to the second face, wherein the peg portion has a height substantially equal to the first peg height, wherein the first peg is disposed at a first row and a first column of an array, and wherein the peg portion of the engaging member is disposed at the first row and a second column of the array.

12. The toy construction assembly according to claim 11, wherein a distal portion of the first peg and a distal portion of the peg portion are substantially uniform in size and shape, and wherein a distal planar surface of the first peg and a distal planar surface of the peg portion lie in a common plane, such that the first peg and the peg portion are configured to be received in complementary uniform coupling recesses defined in a flat surface of a second toy construction element, when the flat surface of the second toy construction element rests on the second face and extends over the flexible member and the face.

13. The toy construction assembly according to claim 11, wherein the flexible member defines a second hole, wherein the toy construction element further comprises a second engaging member disposed on the face and a second peg extending from the second face, wherein the second engaging member includes a second column portion and a second peg portion, wherein the flexible member is assembled with the toy construction element with the second engaging member disposed in the second hole, wherein the second column portion extends from a first end portion at the face to a second end portion at which the second peg portion is disposed, wherein the second column portion has a column height substantially equal to the recess height, wherein the second peg has a height substantially equal to the first peg height, wherein the second peg portion has a height substantially equal to the first peg height, wherein the second peg is disposed at a second row and the first column of the array, and wherein the second peg portion is disposed at the second column and the second row of the array.

14. The toy construction assembly according to claim 13, wherein distal portions of the peg, the peg portion, the second peg, and the second peg portion are substantially similar in size and shape, and wherein distal planar surfaces of the peg, the peg portion, the second peg, and the second peg portion lie in a common plane.

15. The toy construction assembly according to claim 14, further comprising a second toy construction element having a flat surface defining uniform coupling recesses complementary in size and shape to the distal portions of the peg, the peg portion, the second peg, and the second peg portion, and wherein the flat surface of the second toy construction element rests on the second face and extends over the flexible member and the face, with the uniform coupling recesses engaged with the distal portions of the peg, the peg portion, the second peg, and the second peg portion.

16. The toy construction assembly according to claim 11, wherein a thickness of the flexible member is substantially equal to the recess height.

17. The toy construction assembly according to claim 11, wherein the array comprises a plurality of pegs arranged on the second face and a plurality of peg portions of engaging members arranged on the first face, the array comprising at least two rows and at least two columns.

18. A toy construction assembly, comprising:

a flexible member defining a hole; and a toy construction element comprising:

a face; and an engaging member disposed on the face, the engaging member including a column portion and a peg portion, wherein the column portion extends from a first end portion at the face to a second end portion at which the peg portion is disposed, wherein the flexible member is assembled with the toy construction element with the engaging member disposed in the hole wherein the toy construction element has a second face, wherein the face is recessed from the second face by a recess height, wherein a substantially perpendicular face extends between the face and the second face, wherein the flexible member has an edge configured to confront the perpendicular face when the flexible member is assembled with the toy construction element, and wherein a width between the hole and the edge is greater than a distance between the column portion and the perpendicular face.

19. A toy construction element, comprising:

a base portion having a first face and a second face, the first face being recessed from the second face;

a peg extending from the second face; and an engaging member disposed on the first face, the engaging member including a column portion and a peg portion, wherein the peg and the peg portion are disposed within a first two-dimensional array of projecting portions, with the peg disposed at a first position of the first two-dimensional array of projecting portions and the peg portion disposed at a second position of the first two-dimensional array of projecting portions, wherein the first two-dimensional array of projecting portions is disposed in a first plane of a three-dimensional toy construction matrix, wherein the base portion defines a coupling recess on a side of the toy construction element that is opposite the first face, wherein the coupling recess is configured to receive a corresponding peg of another toy construction element, with the corresponding peg disposed at a position within a second two-dimensional array of projecting portions, and wherein the second two-dimensional array of projecting portions is disposed in a second plane of the three-dimensional toy construction matrix that is different from the first plane of the three-dimensional toy construction matrix.

20. A toy construction element according to claim 19, wherein the peg has substantially similar dimensions as the peg portion.

* * * * *